US007394344B2

(12) United States Patent
Yoneda

(10) Patent No.: US 7,394,344 B2
(45) Date of Patent: Jul. 1, 2008

(54) CHIP RESISTOR AND METHOD FOR MANUFACTURING THE SAME

(75) Inventor: Masaki Yoneda, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 221 days.

(21) Appl. No.: 11/069,829

(22) Filed: Feb. 28, 2005

(65) Prior Publication Data

US 2005/0275503 A1 Dec. 15, 2005

(30) Foreign Application Priority Data

Feb. 27, 2004 (JP) ..... 2004-054144
Feb. 27, 2004 (JP) ..... 2004-054145

(51) Int. Cl.
*H01C 1/012* (2006.01)

(52) U.S. Cl. ..... 338/309; 338/307

(58) Field of Classification Search ..... 338/22 R, 338/279–281, 283–284, 287, 293, 306–314, 338/326, 328, 330, 332–333, 322–324; 219/521, 219/553; 29/610
See application file for complete search history.

(56) References Cited

U.S. PATENT DOCUMENTS 4,906,821 A * 3/1990 Bechevet et al. ..... 338/333
5,321,382 A * 6/1994 Mizukoshi et al. ..... 338/53
6,150,920 A * 11/2000 Hashimoto et al. ..... 338/309
2004/0012479 A1 1/2004 Yamada et al.

FOREIGN PATENT DOCUMENTS

JP 03072601 A * 3/1991
JP 2000-216001 8/2000
JP 2001-338801 12/2001
JP 2002-203702 7/2002

* cited by examiner

*Primary Examiner*—Elvin Enad
*Assistant Examiner*—Joselito Baisa
(74) *Attorney, Agent, or Firm*—Hamre, Schumann, Mueller & Larson, P.C.

(57) ABSTRACT

A chip resistor includes a chip substrate, a terminal electrode formed on an upper surface of the chip substrate in a region close to the respective end portions, and a resistant film formed in a zigzag-folded shape on the upper surface of the chip substrate between the terminal electrodes. An inner edge of at least one of the terminal electrodes includes a protrusion integrally formed so as to project from a portion close to a side edge of the chip substrate toward the resistant film, for achieving electrical connection between the resistant film and the protrusion. A side edge of the protrusion facing inward farther from the side edge of the chip substrate is inclined such that a front edge of the protrusion has a narrower width.

8 Claims, 6 Drawing Sheets

Prior Art

Prior Art

CHIP RESISTOR AND METHOD FOR MANUFACTURING THE SAME

TECHNICAL FIELD

The present invention relates to a chip resistor including a chip-type insulating substrate and a resistant film provided on the upper surface of the substrate, particularly to a chip resistor having an upgraded surge resistance, and to a method for manufacturing the same.

BACKGROUND ART

Generally, chip resistors constituted of a chip-type insulating substrate and a resistant film provided on the upper surface thereof are not provided with sufficient surge resistance, and hence the resistance is prone to fluctuate when a surge voltage is applied, for example because of an influence of static electricity or a power source noise. For improving the surge resistance, extending a length of a path on the resistant film through which a current runs is known as an effective remedy.

Accordingly, a conventional chip resistor is provided with a terminal electrode on the respective longitudinal end portions on the upper surface of the substrate made of a heat-resistant insulating material such as a ceramic, and a resistant film located in a zigzag-folded shape between the terminal electrodes on the upper surface of the chip substrate for electrical connection, thus to secure a maximal length of the current path through the resistant film.

Under such structure, however, when a surge voltage is applied to the path between the terminal electrodes, discharge may take place between the zigzag-shaped resistant film and an inner edge of the terminal electrodes, by which the surge resistance of the resistant film is degraded.

A solution of this problem is provided by prior art disclosed in JP-A 2000-216001 and JP-A 2002-203702. Referring to FIGS. 8 and 9, a chip substrate 201 is provided with a terminal electrode 202, 203 located in a region close to respective edges 201*a*, 201*b*, and a resistant film 204 located between the terminal electrodes 202, 203, including a plurality of slits 211 that form the zigzag shape of the resistance film. In this chip resistor, the terminal electrodes 202, 203 respectively include a protrusion 205, 206 protruding from a portion of the inner edge 202*a*, 203*a* close to a side edge 201*c* of the chip substrate 201 toward the resistant film 204, and the resistant film 204 includes a lug 207, 208 formed at the respective end portions. The lugs 207, 208 are respectively disposed on or under the protrusions 205, 206 of the terminal electrodes 202, 203, so that the lugs 207, 208 overlap the protrusions 205, 206 for electrical connection, by which a gap 209, 210 is defined between the inner edge 202*a*, 203*a* of the terminal electrodes 202, 203 and the outer edge 204*a*, 204*b* of the resistant film 204. Such a structure prevents discharge between the inner edge 202*a*, 203*a* of the terminal electrode 202, 203 and the outer edge 204*a*, 204*b* of the resistant film 204, while securing a sufficient length of the current path through the resistant film 204.

Regarding a method of forming the zigzag-shaped resistant film, JP-A 2001-338801 proposes placing the resistant film of a certain width between the terminal electrodes such that the end portions of the resistant film in a longitudinal direction are electrically connected to the terminal electrodes respectively, by screen printing or the like. Simultaneously with the screen printing process, a first slit, which is a part of the foregoing plurality of slits, is formed on a side edge of the resistant film. Further, on the opposite side edge of the resistant film, a second slit is engraved through a processing work such as irradiation of a laser beam, subsequent to the formation of the resistant film. Such process can extend the current path in a zigzag pattern, through which the current runs from one of the terminal electrodes to the other.

In such process, the processing work such as the irradiation of a laser beam for engraving the second slit also includes a trimming adjustment for maintaining the resistance value of the resistant film within a predetermined tolerance, and is hence performed after the formation of the resistant film by screen printing or the like.

The prior art according to JP-A 2000-216001 or JP-A 2002-203702, however, has the following drawback arising from the structure that the side edges 205*b*, 206*b* of the protrusions 205, 206 of the terminal electrodes 202, 203, opposite to the outer side edges 205*a*, 206*a* close to the side edge 201*c* of the chip substrate 201, are orthogonal to the inner edges 202*a*, 203*a* of the terminal electrodes 202, 203.

When forming the resistant film 204 and the terminal electrodes 202, 203 disposed on the end portions of the latter by screen printing or the like, a positioning error is inevitably incurred therebetween, such as a case indicated by a double dashed chain line in FIG. 9, where the resistant film 204 is shifted with respect to the terminal electrodes 202, 203. Accordingly, the width W of the protrusions 205, 206 has to be sufficiently large, so as to keep the lugs 207, 208 of the resistant film 204 from passing over the inwardly facing side edges 205*b*, 206*b* of the protrusions 205, 206, even with an assumed maximum positioning error.

Whereas, making the width W larger, with the respective inwardly facing side edges 205*b*, 206*b* of the protrusions 205, 206 of the terminal electrodes 202, 203 oriented orthogonal to the inner edges 202*a*, 203*a* of the terminal electrodes 202, 203, reduces a length L' of a portion of the outer edges 204*a*, 204*b* of the resistant film 204 opposing the inner edge 202*a*, 203*a* of the terminal electrodes 202, 203, in other words the length of the gaps 209, 210 serving for preventing the discharge is reduced by the same amount that the width W of the protrusions 205, 206 is increased. Consequently, the length of the current path of the resistant film 204 is reduced, and the surge resistance of the resistant film 204 is thereby degraded.

In addition, referring to the formation of the second slit on the resistant film by the processing work according to the prior art proposed in JP-A2001-338801, when the position to engrave the second slit is shifted in a widthwise direction of the slit, the width between the second slit and the first slit simultaneously formed with the resistant film, and also the gap between the second slit and the terminal electrodes fluctuate to a wider or narrower side. This results in fluctuation in resistance value of the resistant film.

A conventional solution of the above problem is shooting an entirety of the chip substrate by a camera, and determining a position to engrave the second slit on the image, based on the overall shape of the resistor. However, since a positional shift incurred in the screen printing process of the resistant film may be added to the positioning error for the second slit in a widthwise direction of the slit, the total positioning error may become excessively large, thus to exceed the tolerance in positioning error. Consequently, the rate of defective products having a resistance value deviated from a predetermined range becomes higher.

Besides, it takes considerable time in determining the position to be engraved in the image of the entire resistant film, before performing the processing work of engraving the second slit, which naturally incurs an increase in cost.

DISCLOSURE OF THE INVENTION

It is an object of the present invention to provide a technique of eliminating the foregoing problem incidental to a chip resistor, and a method for manufacturing the chip resistor thus designed.

Accordingly, a first aspect of the present invention provides a chip resistor comprising a chip substrate; a terminal electrode formed on an upper surface of the chip substrate in a region close to the respective end portions; a resistant film formed in a zigzag-folded shape on the upper surface of the chip substrate between the terminal electrodes; an inner edge of at least one of the terminal electrodes including a protrusion integrally formed so as to project from a portion close to a side edge of the chip substrate toward the resistant film for achieving electrical connection between the resistant film and the protrusion; wherein a side edge of the protrusion facing inward farther from the side edge of the chip substrate is inclined such that a front edge of the protrusion has a narrower width.

In the chip resistor thus constructed, since the inwardly facing side edge of the protrusion included in the terminal electrode is inclined such that the front edge of the protrusion has a narrower width, the portion of the outer edge of the resistant film opposing the inner edge of the terminal electrode can be kept from being shortened to an extent defined by the inclination of the inwardly facing side edge of the protrusion, when the width of the protrusion is determined so as to absorb an assumed maximum relative positioning error between the resistant film and the terminal electrode. Accordingly, the current path in the resistant film can be extended in comparison with the prior art, which assures that the resistant film can attain upgraded surge resistance.

Preferably, an angle between the inclined side edge and the inner edge of the terminal electrodes is 160 degrees or less.

Preferably, the zigzag-folded shaped resistant film includes a first slit inwardly extending from a side of the resistant film formed in the process of forming the resistant film, a second slit engraved inward from the other side of the resistant film by a processing work such as irradiation of a laser beam, performed after the formation of the resistant film, and a cutaway portion located at a reference position on the other side of the resistant film for engraving the second slit, formed during the formation process of the resistant film.

In the chip resistor thus constructed, the cut away portion is formed on the other side of the resistant film during the formation process thereof, so that the cutaway portion serves as the reference position for engraving the second slit. Such arrangement allows quickly and accurately identifying with the cutaway portion the position to locate the second slit, when engraving the second slit on the resistant film. Accordingly, the positioning error of the second slit in a widthwise direction of the second slit committed during the processing work of engraving the second slit can be significantly reduced when compared with the conventional method of determining the position to be engraved based on a total image of the resistant film, which substantially lowers the defect rate because of the positioning error, and also reduces the manufacturing cost since the time required for engraving the second slit can be considerably shortened.

Preferably, the width of the cutaway portion is made larger than the width of the second slit, so that the initial edge of the second slit is located inside the cutaway portion. Such configuration allows limiting the positioning error of the second slit in a widthwise direction in particular, to be within width range of the cutaway portion.

Preferably, the width of the cutaway portion is set so as not to cause an excess over a maximum tolerance of the widthwise positioning error of the second slit. Such configuration further assures the foregoing effect of reducing the widthwise positioning error of the second slit, since such positioning error can be restricted by the maximum tolerance.

A second aspect of the present invention provides a method for manufacturing a chip resistor, comprising forming a terminal electrode on an upper surface of a chip substrate in a region close to the respective end portions; and forming a resistant film on the upper surface of the chip substrate between the terminal electrodes; wherein the step of forming the terminal electrodes includes integrally forming a protrusion projecting from a portion of an inner edge of at least one of the terminal electrodes close to a side edge of the chip substrate toward the resistant film, for achieving electrical connection with the resistant film; and the step of forming the protrusion includes forming a side edge of the protrusion facing inward farther from the side edge of the chip substrate with an inclination such that a front edge of the protrusion has a narrower width.

Preferably, the step of forming the resistant film includes electrically connecting the end portions of the resistant film with the pair of terminal electrodes respectively, and forming a first slit so as to inwardly extend from a side of the resistant film, and subsequently performing a processing work such as irradiation of a laser beam, thus to engrave a second slit inwardly extending from the other side of the resistant film; and the step of forming the resistant film further includes forming a cutaway portion at a reference position on the other side of the resistant film for engraving the second slit, and the step of engraving the second slit includes identifying the position to be engraved inside the cutaway portion.

Other features and benefits of the present invention will become more apparent through description of preferred embodiment based on the accompanying drawings.

BEST MODE FOR CARRYING OUT THE INVENTION

Hereunder, embodiments of the present invention will be described based on the accompanying drawings.

Figure 1:
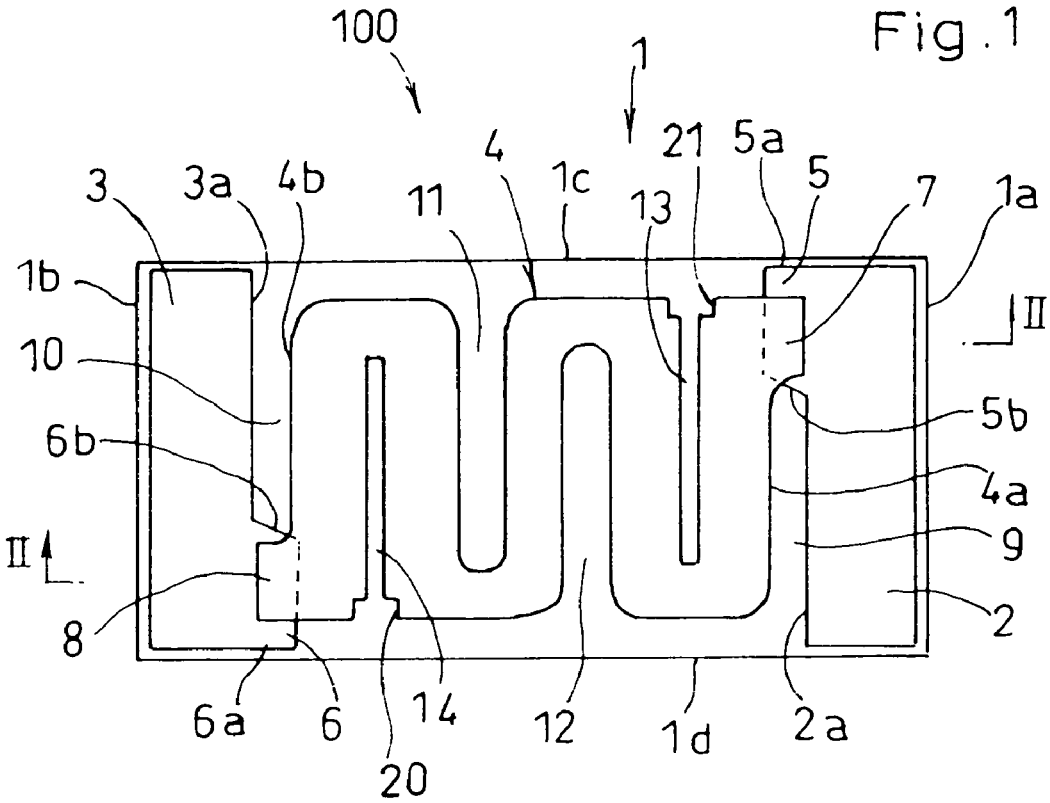
FIG. 1 is a plan view showing a chip resistor according to a first embodiment of the present invention.
Figure 2:
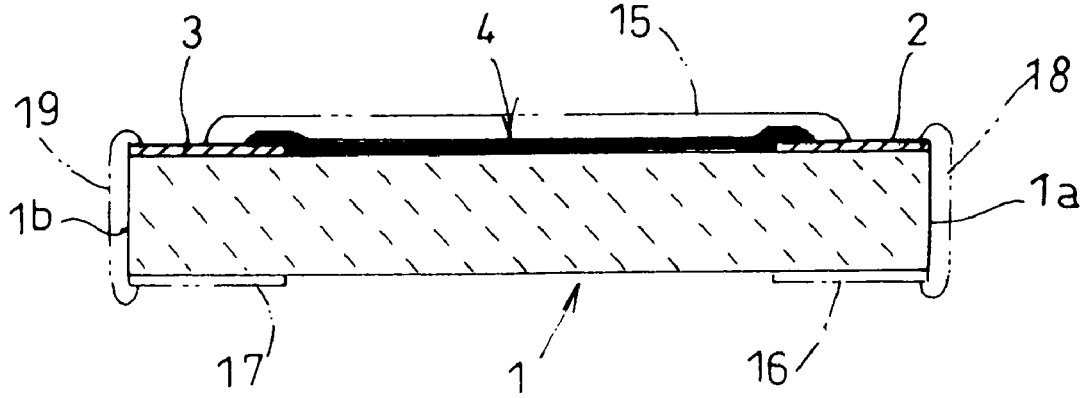
FIG. 2 is a cross-sectional view taken along the line II-II of FIG. 1.
Figure 3:
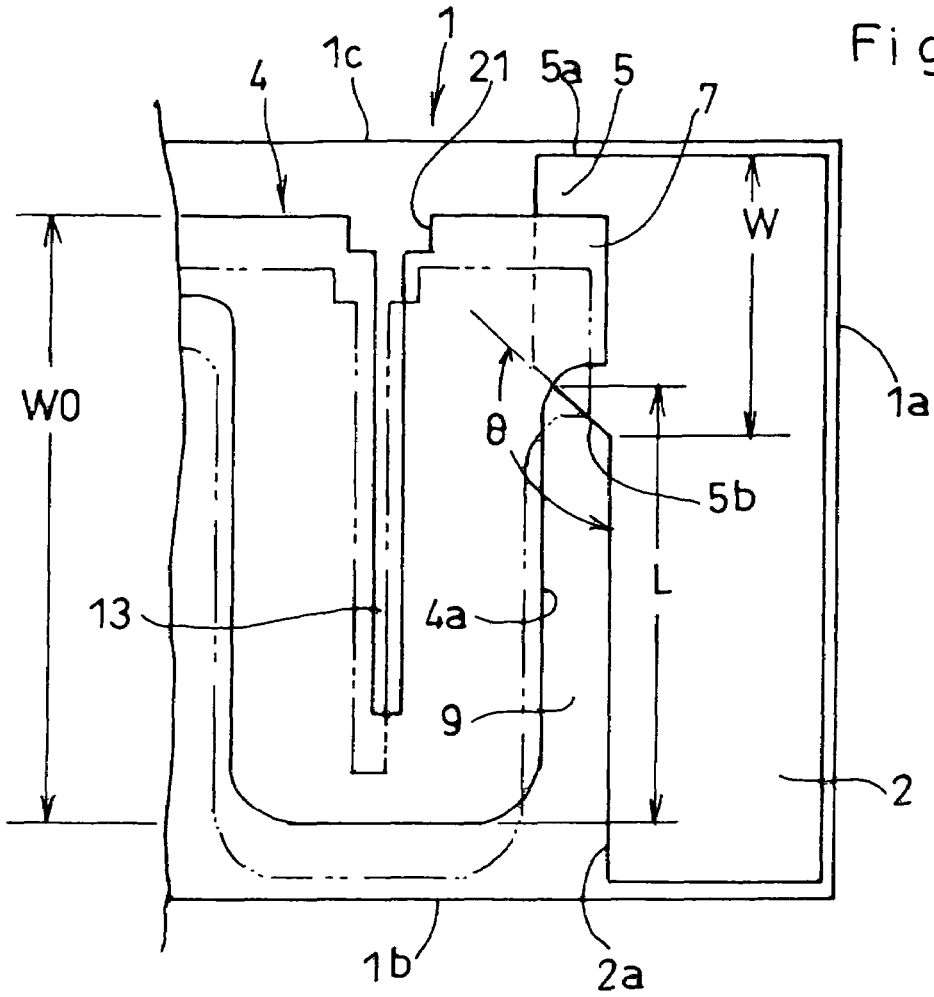
FIG. 3 is an enlarged fragmentary view of the chip resistor shown in FIG. 1.

FIGS. 1 to 3 depict a chip resistor according to a first embodiment of the present invention.

The chip resistor 100 includes a chip substrate 1 made of a heat-resistant insulating material such as a ceramic and formed in a rectangular shape, and a terminal electrode 2, 3 located on the upper surface of the chip substrate 1 in a region close to the respective ends 1*a*, 1*b* in a longitudinal direction, by screen-printing the paste of the terminal electrode material and a subsequent sintering process.

In a region between the terminal electrodes 2, 3 on the upper surface of the chip substrate 1, a resistant film 4 of an appropriate width (width W0) is provided so as to extend in a longitudinal direction of the chip substrate 1, by screen-printing the paste of the resistant film material and a subsequent sintering process.

When forming the terminal electrodes 2, 3, the inner edge 2*a* of the terminal electrode 2*a* includes a protrusion 5 located in a portion close to a side edge 1*c* of the chip substrate 1, and the inner edge 3*a* of the other terminal electrode 3 includes a protrusion 6 located in a portion close to the other side edge 1*d* of the chip substrate 1, both integrally formed with the respective terminal electrodes, so as to protrude toward the resistant film 4.

When forming the resistant film 4, a lug 7, 8 is integrally formed on the respective outer edges 4*a*, 4*b*, and the lugs 7, 8 are respectively disposed so as to overlap the protrusions 5, 6 of the terminal electrodes 2, 3 for achieving electrical connection, and to define a gap 9, 10 between the outer edge 4*a*, 4*b* of the resistant film 4 and the inner edge 2*a*, 3*a* of the terminal electrodes 2, 3 respectively, thus to avoid discharge.

The resistant film 4 also include a first slit 11 inwardly extending from a longitudinal side and another first slit 12 inwardly extending from the other longitudinal side, simultaneously formed when screen-printing the resistant film 4, and two second slits 13, 14 formed by a processing work such as irradiation of a laser beam performed after the formation of the resistant film 4, so as to obtain a zigzag-folded shape.

Obviously, the resistant film 4 may be first formed on the chip substrate, and the terminal electrodes 2, 3 may be subsequently formed, so that the protrusions 5, 6 of the terminal electrodes 2, 3 are respectively disposed so as to overlap the lugs 7, 8 on the end portions of the resistant film 4, in another embodiment.

When forming the terminal electrodes 2, 3, the inwardly facing side edge 5*b* out of the side edges 5*a*, 5*b* of the protrusion 5 of the terminal electrode 2, located farther from the side edge 1*c* of the chip substrate 1 is formed with an inclination with respect to the inner edge 2*a* of the terminal electrode 2, such that the width W of the protrusion 5 becomes narrower at a front end thereof. Likewise, the inwardly facing side edge 6*b* out of the side edges 6*a*, 6*b* of the protrusion 6 of the terminal electrode 3, located farther from the other side edge 1*d* of the chip substrate 1 is formed with an inclination with respect to the inner edge 3*a* of the terminal electrode 3, such that the width W of the protrusion 6 becomes narrower at a front end thereof.

Figure 8:
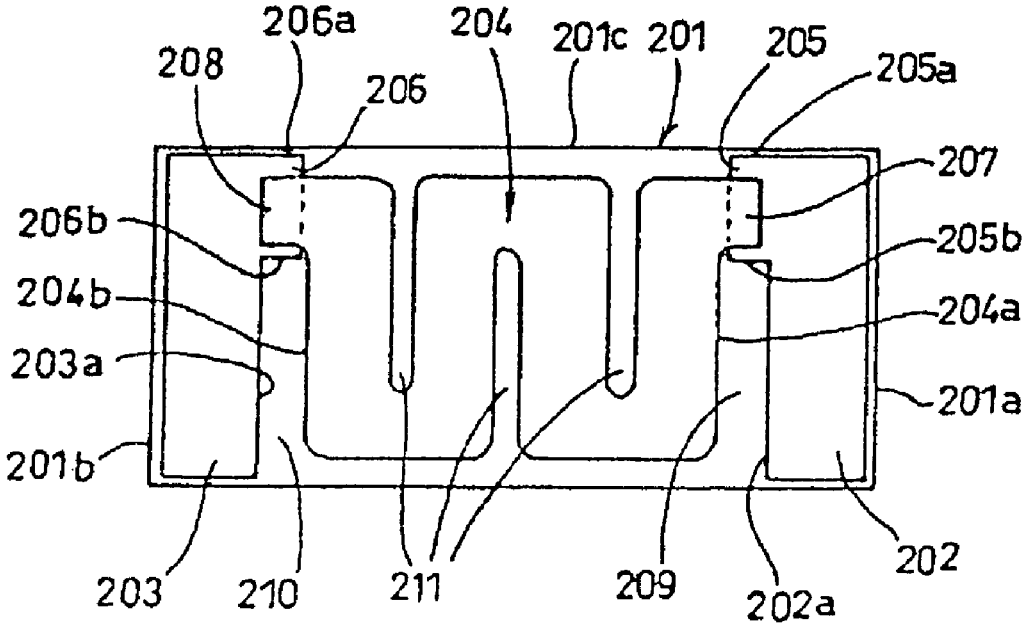
FIG. 8 is a plan view showing a chip resistor according to a prior art.
Figure 9:
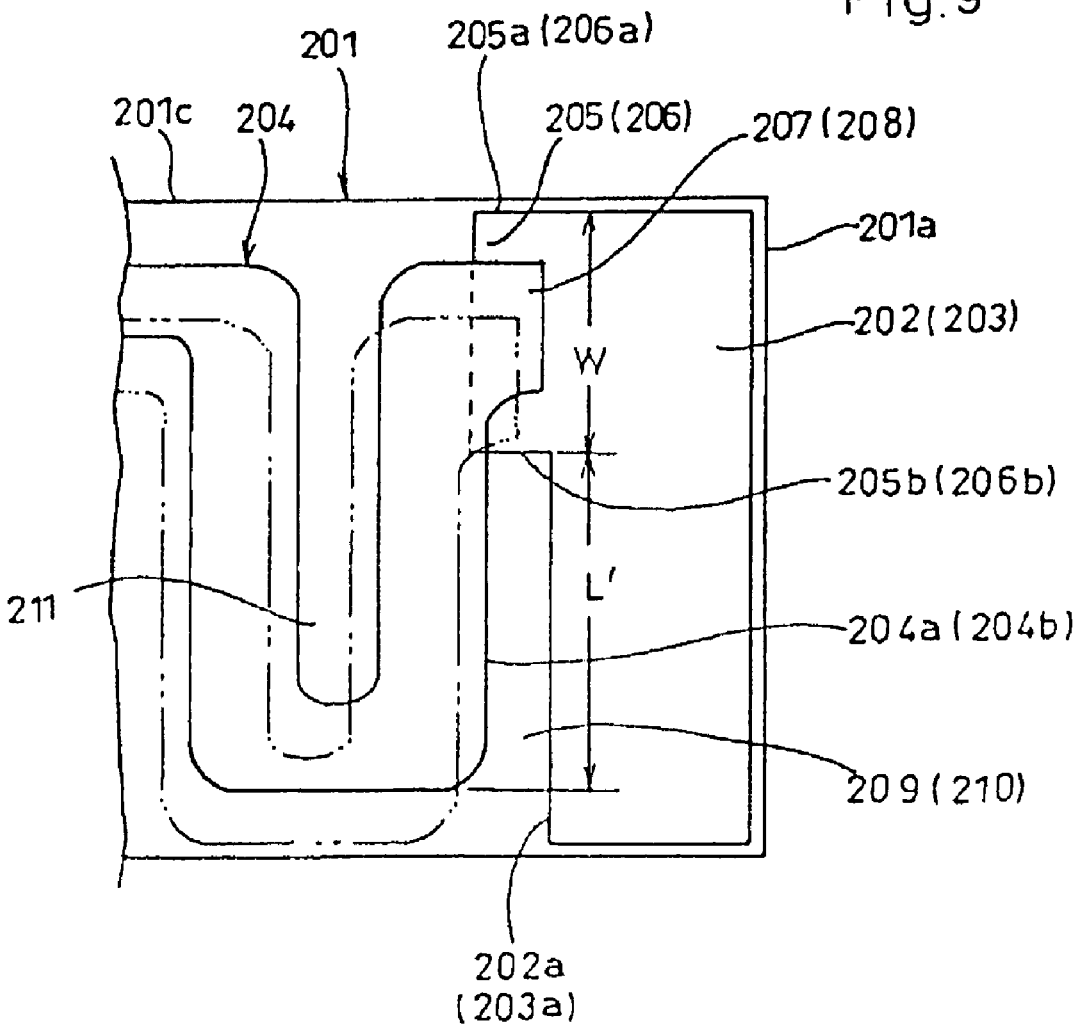
FIG. 9 is an enlarged fragmentary view of the chip resistor shown in FIG. 8.

Under such structure, the width W of the protrusions 5, 6 of the terminal electrodes 2, 3 is set to be sufficiently large as in the prior art shown in FIGS. 8 and 9, so as to keep the lugs 7, 8 of the resistant film 4 from passing over the inwardly facing side edges 5*b*, 6*b* of the protrusions 5, 6, even when the resistant film 4 and the terminal electrodes 2, 3 are relatively shifted because of an error in the screen printing as shown by a double dashed chain line in FIG. 3, to an assumed maximum extent.

Referring to FIG. 2, numeral 15 designates a cover coating provided so as to cover the entire resistant film 4, after performing the processing work to engrave the second slits 13, 14; numerals 16, 17 designate terminal electrodes formed on the lower surface of the chip substrate 1; and numerals 18, 19 designate lateral terminal electrodes provided on the end faces 1*a*, 1*b* of the chip substrate 1, for connecting the upper terminal electrodes 2, 3 and the lower terminal electrodes 16, 17, respectively.

Forming the inwardly facing side edges 5*b*, 6*b* of the protrusions 5, 6 of the terminal electrodes 2, 3 with an inclination, such that the width W of the protrusion 5, 6 becomes narrower at the front end thereof as already stated, makes the length L of the portion of the outer edges 4*a*, 4*b* of the resistant film 4 opposing the inner edges 2*a*, 3*a* of the terminal electrodes 2, 3, i.e. the length of the gaps 9, 10, longer than in the case where the inwardly facing side edges 5*b*, 6*b* are orthogonal with respect to the inner edges 2*a*, 3*a* of the terminal electrodes 2, 3, by an extent defined by the inclination of the inwardly facing side edges 5*b*, 6*b*.

In other words, the length L of the portion of the outer edges 4*a*, 4*b* of the resistant film 4 opposing the inner edges 2*a*, 3*a* of the terminal electrodes 2, 3 can be kept from being shortened to an extent defined by the inclination of the inwardly facing side edges 5*b*, 6*b* of the protrusions 5, 6, when the width W of the protrusions 5, 6 is determined so as to absorb an assumed maximum relative positioning error between the resistant film 4 and the terminal electrodes 2, 3.

In this respect, according to experiments carried out by the present inventors, when the angle θ between the inwardly facing side edges 5*b*, 6*b* and the inner edges 2*a*, 3*a* of the terminal electrode 2, 3 exceeds 160 degrees, the angle between the inwardly facing side edges 5*b*, 6*b* and the outer edges 4*a*, 4*b* of the resistant film 4 becomes so small that discharge becomes prone to take place therebetween, thus virtually reducing the length of the gaps 9, 10 to a similar level to the prior art. Accordingly, it has been proven that it is preferable to set the angle θ at 160 degrees or less.

When performing the processing work of engraving the second slits 13, 14 on the resistant film 4, a cutaway portion 20, 21 is provided at the respective positions on the resistant film 4 where the processing work for forming the second slits 13, 14 is supposed to be started, simultaneously with the formation of the resistant film 4 by screen printing or the like. The cutaway portions 20, 21 serve to facilitate identifying the position to start the processing work of engraving the second slits 13, 14, with high precision. Details of this effect will be described based on a second embodiment.

Figure 4:
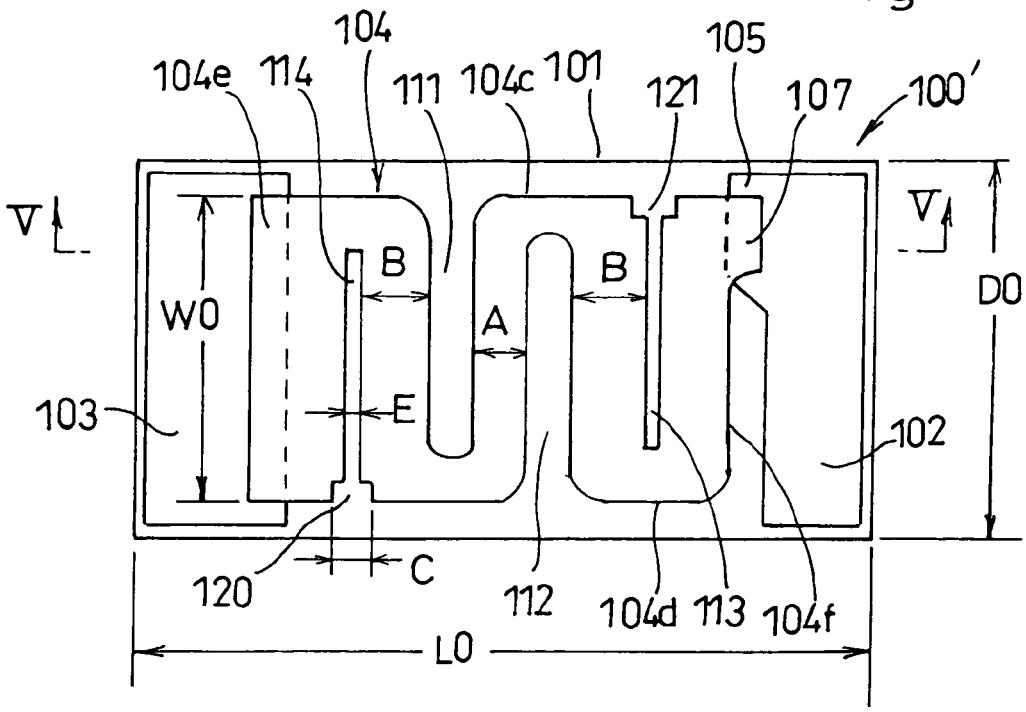
FIG. 4 is a plan view showing a chip resistor according to a second embodiment of the present invention.
Figure 5:
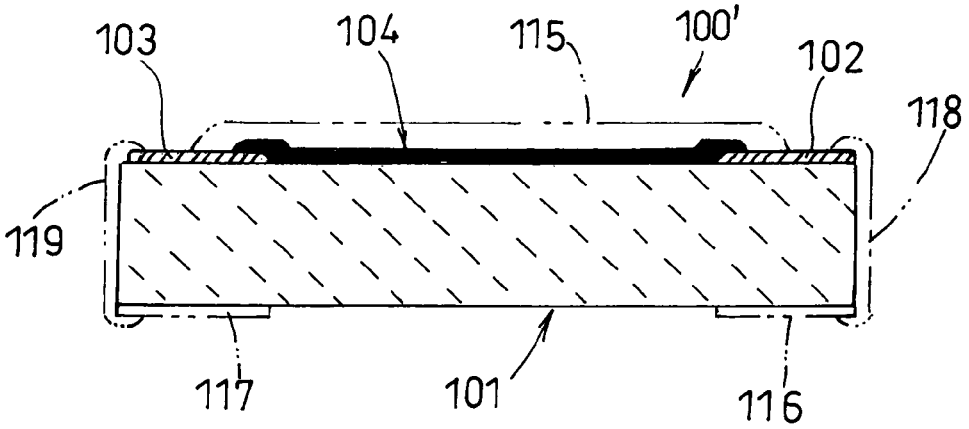
FIG. 5 is a cross-sectional view taken along the line V-V of FIG. 4.

The second embodiment of the present invention will now be described referring to FIGS. 4 to 7, among which FIGS. 4 and 5 depict a chip resistor 100' according to the second embodiment.

The chip resistor 100' includes a chip substrate 101 made of a heat-resistant insulating material such as a ceramic and formed in a rectangular shape having a width D0 and a length L0, a terminal electrode 102, 103 located on the upper surface of the chip substrate 101, and a resistant film 104 of a width W0 extending between the terminal electrode 102, 103 on the upper surface of the chip substrate 101, along a longitudinal direction thereof. The terminal electrode 102, 103 and the resistant film 104 are formed by screen-printing the paste of the material of the respective components, and a subsequent sintering process.

An end portion 104*e* of the resistant film 104 overlaps the terminal electrode 103 in the entire original width W0 of the resistant film 104, for electrical connection. The other end portion 104*f* of the resistant film 104 is provided with a lug 107 integrally formed at a position closer to the side edge 104*c*, out of the side edges 104*c*, 104*d* in a longitudinal direction of the resistant film 104, and the lug 107 is disposed so as to overlap the protrusion 105 included in the other terminal electrode 102, for electrical connection. The protrusion 105 is formed in a similar manner to the protrusion 5 in the first embodiment.

Figure 6:
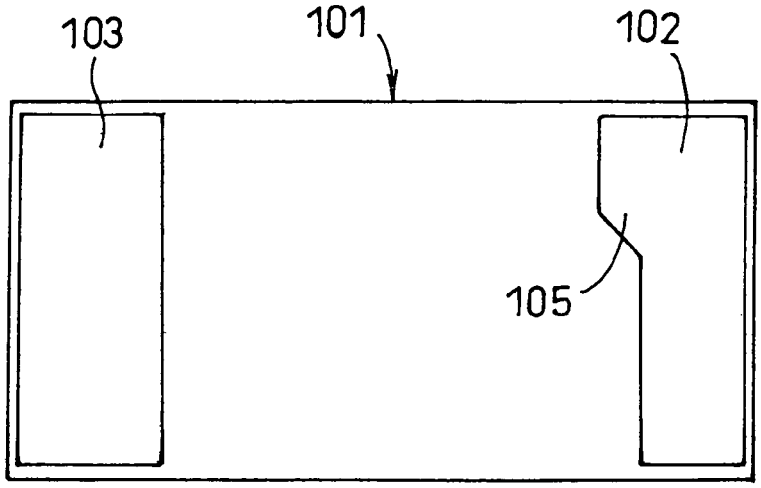
FIG. 6 is a plan view for explaining a formation process of a terminal electrode on a chip substrate, in a method for manufacturing a chip resistor.
Figure 7:
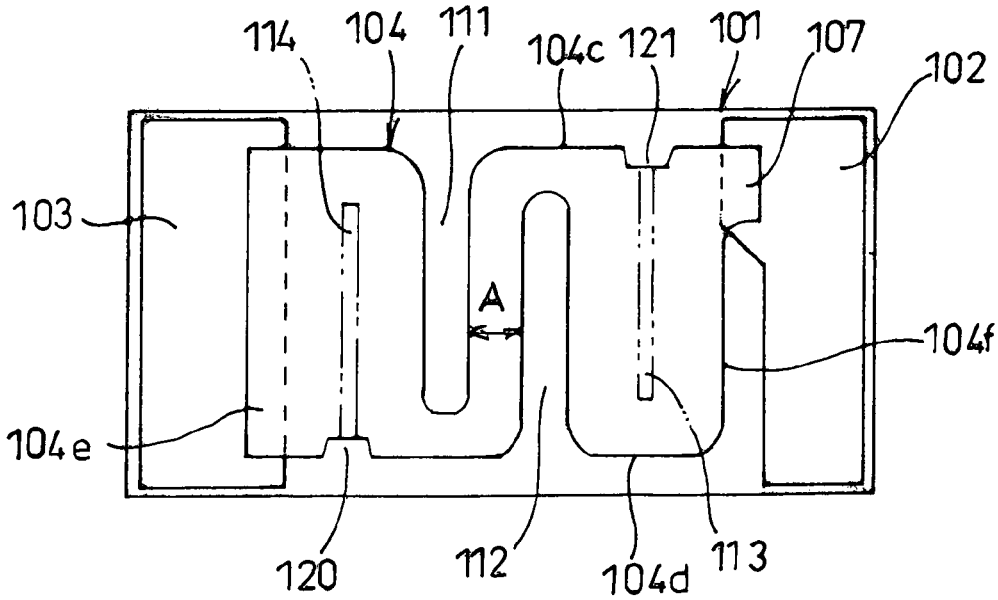
FIG. 7 is a plan view for explaining a formation process of a resistant film on a chip substrate, in a method for manufacturing a chip resistor.

To build up such a structure, the pair of terminal electrodes 102, 103 is formed on the upper surface of the chip substrate 101 as shown in FIG. 6, and then the resistant film 104 is placed such that the end portions respectively overlap the terminal electrodes 102, 103 as shown in FIG. 7. Alternatively, the resistant film 104 may be formed first, and the pair of terminal electrodes 102, 103 subsequently, so as to achieve electrical connection with the end portions of the resistant film 104, in another embodiment.

Also, the resistant film 104 includes a first slit 111 extending from a side edge 104*c* toward the opposite side edge 104*d* and another first slit 112 extending from the opposite side edge 104*d* toward the side edge 104*c*, simultaneously formed in the screen printing process or the like to form the resistant film 104.

In this process, the first slits 111, 112 are disposed side by side at a generally central portion in a longitudinal direction of the resistant film 104 with a predetermined film width A secured therebetween, such that one of the first slits 111 is disposed closer to the end portion 104*e* of the resistant film 104, while the other first slit 112 is disposed closer to the other end portion 104*f* of the resistant film 104.

Further, in a region between the end portion 104*e* and one of the first slits 111 of the resistant film 104, a second slit 114 is engraved so as to extend inward from the opposite side edge 104*d* toward the side edge 104*c*, by a processing work such as irradiation of a laser beam. Likewise, in a region between the other end portion 104*f* and the other first slit 112 of the resistant film 104, another second slit 113 is engraved so as to extend inward from the side edge 104*c* toward the opposite side edge 104*d*, by a processing work such as irradiation of a laser beam. This process completes the formation of the resistant film 104 in a zigzag-folded shape delineated by the first slits 111, 112 and the second slits 113, 114.

Referring to FIG. 5, numeral 115 designates a cover coating provided so as to cover the entire resistant film 104, after performing the processing work to engrave the second slits 113, 114; numerals 116, 117 designate terminal electrodes formed on the lower surface of the chip substrate 101; and numerals 118, 119 designate lateral terminal electrodes provided on the end faces of the chip substrate 101, for connecting the upper terminal electrodes 102, 103 and the lower terminal electrodes 116, 117, respectively.

When performing the screen printing or the like to form the resistant film 4, a cutaway portion 120, 121, which serves as a reference position for identifying the position where the second slits 113, 114 are supposed to be formed, is simultaneously formed on the side edges 104*c*, 104*d* of the resistant film 4.

When performing the processing work such as the irradiation of a laser beam, to engrave the second slits 113, 114 on the resistant film 104, upon completing the formation of the cutaway portions 120, 121 on the resistant film 104, the positions to start engraving the second slits 113, 114 are determined by recognizing the cutaway portions 120, 121 in a shot image of the upper surface of the chip substrate 101, so as to enable starting the engraving operation.

In other words, since the identification of the positions where the second slits 113, 114 are supposed to be provided is achieved through the recognition of the positions of the cutaway portion 120, 121, which are nothing but the positions where the second slits 113, 114 are to be formed, an amount of a positional shift of the second slits 113, 114 in a widthwise direction can be significantly reduced in comparison with the conventional technique of identifying the position to form the second slits 113, 114 on an image of the entire resistant film 104, and also the time required for identifying the position can be substantially shortened when compared with the conventional technique.

In the case where a plurality of second slits is to be formed on a single resistant film, such as the foregoing case of providing the two second slits 113, 114 on the resistant film 104, the slits can be engraved with a single processor.

Accordingly, since the spacing between the second slits can be adjusted with high precision by the processor, the cutaway portion that serves as the reference position for forming the second slit does not have to be provided for each of the plurality of second slits, but may be provided with respect to just one of the second slits to be engraved first, in which case the foregoing object of the present invention can be duly achieved.

Also, forming the cutaway portions 120, 121 in a width C along a longitudinal direction of the resistant film 104 larger than a width E of the second slits 113, 114, so as to include the starting point of the engraving operation of the second slits 113, 114 in a region defined by the width C of the cutaway portions 120, 121, makes the cutaway portions 120, 121 easier to be identified on an image. Besides, the positioning error of the second slits 113, 114 in a longitudinal direction of the resistant film 104 can be restricted to be within the range delimited by the width C of the cutaway portion 120, 121.

Further, it is appropriate to set the film width B between each of the first slits 111, 112 and each of the second slits 114, 113 of the resistant film 104 such that a minimum value of the film width B is not surpassed by the film width A between the first slits 111 and 112, even though the second slits 113, 114 are shifted in a widthwise direction thereof. From this, a maximum tolerance can be defined with respect to the positioning error of the second slits 113, 114 in a widthwise direction thereof, such that the film width B between each of the first slits 111, 112 and each of the second slits 114, 113 is not surpassed by the film width A between the first slits 111 and 112.

Accordingly, in addition to forming the second slits 113, 114 inside the cutaway portions 120, 121, setting the width C of the cutaway portion 120, 121 along a longitudinal direction of the resistant film 104 within a range that does not cause an excess over the maximum tolerance, allows restricting the positioning error of the second slits 113, 114 in a longitudinal direction of the resistant film 104 within the maximum tolerance of the positioning error.

It is apparent that the second embodiment of the present invention can be applied to a chip resistor having a different structure from the foregoing embodiments, as long as a resistant film provided on a chip substrate includes a first slit simultaneously formed with the formation of the resistant film, and a second slit engraved by a processing work such as irradiation of a laser beam after the formation of the resistant film. For example, the second embodiment may be applied to the structure described in the first embodiment, in which the resistant film includes a lug not only on the end portion 104*e* but also on the end portion 104*f*, such that the latter lug overlaps the protrusion included in the terminal electrode 103.

What is claimed is:

1. A chip resistor comprising: a chip substrate having an upper surface, a first end, a second end opposite to the first end, a first side edge extending between the first and second ends, and a second side edge opposite to the first side edge and extending between the first and second ends;

first and second terminal electrodes formed on the upper surface of the chip substrate close to the first and second ends, respectively; and a resistant film formed in a zigzag pattern on the upper surface of the chip substrate between the first and second terminal electrodes;

wherein at least the first terminal electrode includes a protrusion integrally formed to project from a portion close to the first side edge of the chip substrate toward the second terminal electrode for electrical connection with the resistant film; and wherein the protrusion includes a non-oblique side edge, an oblique side edge and a connection edge, the non-oblique side edge being adjacent and parallel to the first side edge of the chip substrate, the oblique side edge facing inward away from the first side edge of the chip substrate and, being inclined such that the protrusion has progressively narrower width toward the second terminal electrode, the connection edge connecting the non-oblique side edge and the oblique side edge to each other and being parallel to the first and second ends of the substrate.

2. The chip resistor according to claim 1, wherein the resistant film intersects both the connection edge and the oblique side edge of the protrusion.

3. The chip resistor according to claim 1, wherein the zigzag resistant film includes a first slit extending inwardly from a portion close to one of the first and second side edges toward the other of the first and second side edges; a second slit extending inwardly from a portion close to said other of the first and second side edges toward said one of the first and second side edges.

4. The chip resistor according to claim 3, wherein the resistant film further includes an enlarged cutaway portion at an entry point of the second slit, the cutaway portion having a larger width than the second slit.

5. The chip resistor according to claim 4, wherein the width of the cutaway portion is set so as not to cause an excess over a maximum tolerance of a widthwise positioning error of the second slit.

6. A method for manufacturing a chip resistor, comprising the steps of:

preparing a chip substrate having an upper surface, a first end, a second end opposite to the first end, a first side edge extending between the first and second ends, and a second side edge opposite to the first side edge and extending between the first and second ends;

forming first and second terminal electrodes on the upper surface of the chip substrate close to the first and second ends, respectively; and forming a resistant film on the upper surface of the chip substrate between the first and second terminal electrodes;

wherein the step of forming the first and second terminal electrodes includes integrally forming a protrusion projecting from a portion of at least the first terminal electrode close to the first side edge of the chip substrate toward the second terminal electrode for electrical connection with the resistant film; and the step of forming the protrusion includes causing the protrusion to have a non-oblique side edge, an oblique side edge and a connection edge, the non-oblique side edge being adjacent and parallel to the first side edge of the chip substrate, the oblique side edge facing inward away from the first side edge of the chip substrate with an inclination such that the protrusion has progressively narrower width toward the second terminal electrode, the connection edge connecting the non-oblique side edge and the oblique side edge to each other and being parallel to the first and second ends of the substrate.

7. The method according to claim 6, wherein the step of forming the resistant film includes forming a first slit extending inwardly from a portion close to one of the first and second side edges toward the other of the first and second side edges; forming a second slit extending inwardly from a portion close to said other of the first and second side edges toward said one of the first and second side edges.

8. The method according to claim 7, wherein the step of forming the second slit is started from an enlarged cutaway portion as an entry point of the second slit, the cutaway portion having a larger width than the second slit.

* * * * *